US005828174A

United States Patent [19]

Seiler et al.

[11] Patent Number: 5,828,174

[45] Date of Patent: Oct. 27, 1998

[54] IGNITION DEVICE FOR DISCHARGE LAMP

[75] Inventors: Hartmut Seiler, Baden-Baden; Bernhard Woerner, Reutlingen; Ralf Kramp, Bad Homburg; Martin Frey, Lichtenstein; Ingo Gorille, Oberriexingen; Thomas Fabry, Neckartenzlingen, all of Germany

[73] Assignee: Robert Bosch GmbH, Stuttgart, Germany

[21] Appl. No.: 812,526

[22] Filed: Mar. 7, 1997

[30] Foreign Application Priority Data

Mar. 16, 1996 [DE] Germany ..... 196 10 388.6

[51] Int. Cl.[6] ..... H01J 7/44

[52] U.S. Cl. ..... 315/62; 315/82; 362/265; 361/821

[58] Field of Search ..... 362/265, 61, 310, 362/221; 315/82, 62, 85; 336/57, 183; 361/821, 816, 818

[56] References Cited

U.S. PATENT DOCUMENTS

| | | | |
|---|---|---|---|
| 5,434,763 | 7/1995 | Hege et al. | 362/265 |
| 5,526,232 | 6/1996 | Kolberg et al. | 361/715 |
| 5,530,634 | 6/1996 | Smith | 362/221 |

FOREIGN PATENT DOCUMENTS

4015400A1 11/1991 Germany .

*Primary Examiner*—Don Wong
*Assistant Examiner*—Haissa Philogene
*Attorney, Agent, or Firm*—Michael J. Striker

[57] ABSTRACT

A discharge lamp assembly has a discharge lamp, and an ignition device for the discharge lamp, the ignition device including at least one inductive component and at least one capacitive component, at least a part of one of the components being surrounded by at least a part of the other of the components, the ignition device further having a housing in which the components are arranged and which is connectable with the discharge lamp.

19 Claims, 2 Drawing Sheets

Fig. 1
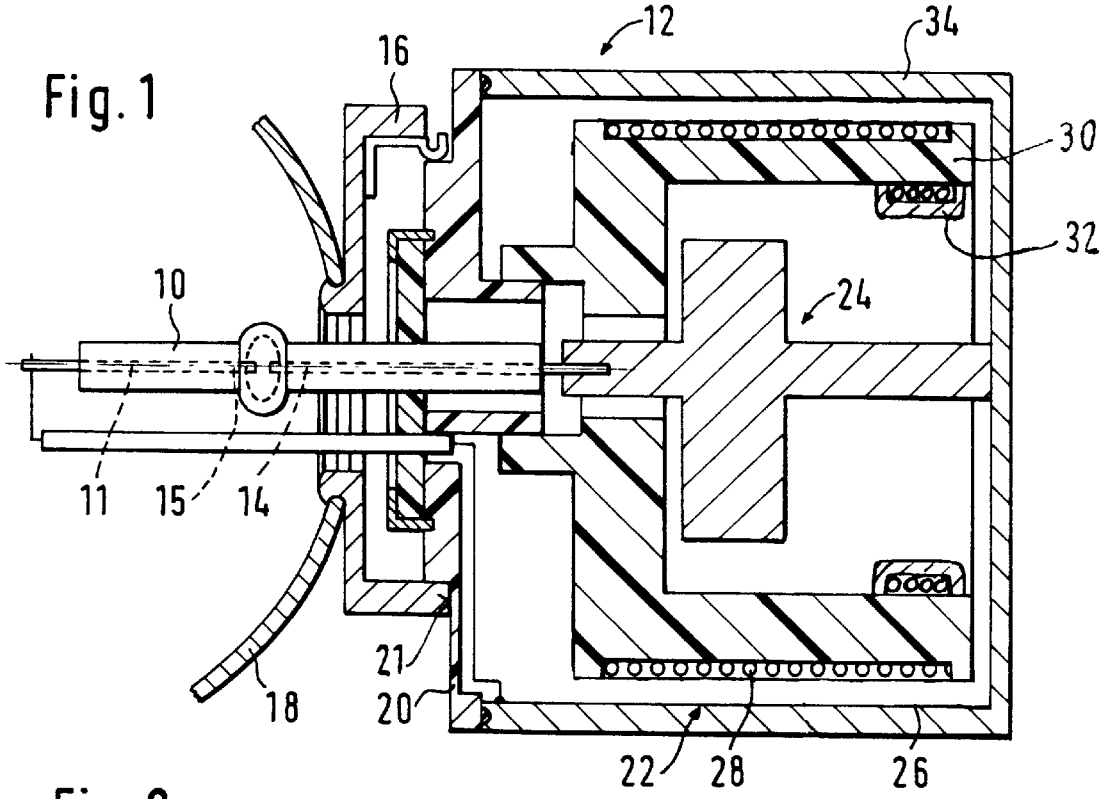
Fig. 2
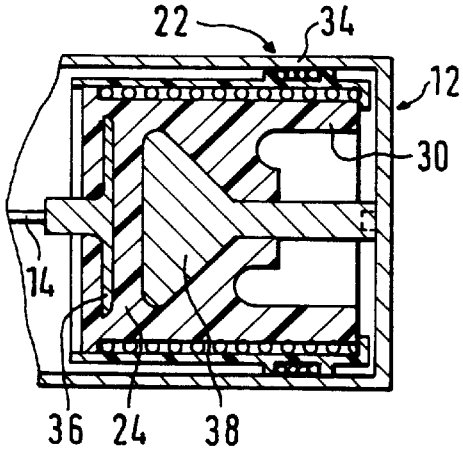
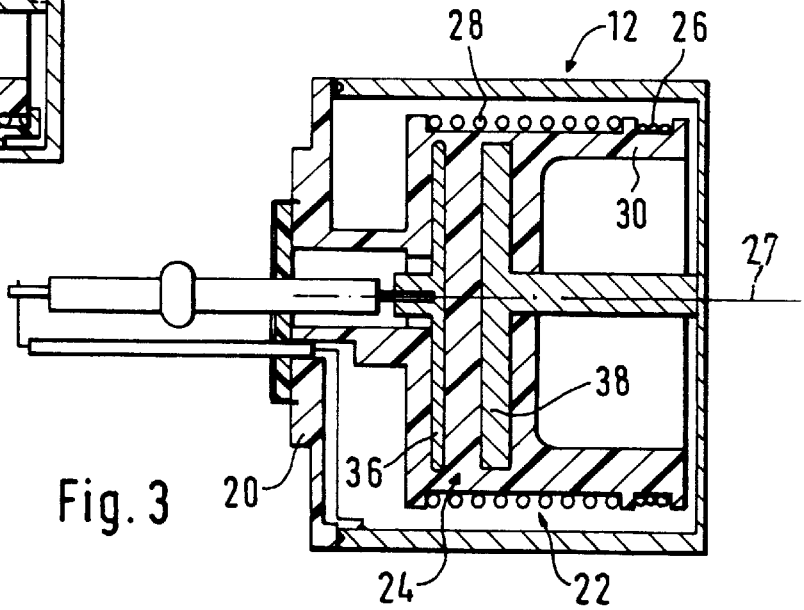
Fig. 3

IGNITION DEVICE FOR DISCHARGE LAMP

BACKGROUND OF THE INVENTION

The present invention relates to an ignition device for a discharge lamp.

Ignition devices of the above mentioned general type are known in the art. One of such ignition devices are disclosed for example in the German patent document DE 40 15 400 A1. The ignition device has at least one inductive component and at least one capacitive component. The ignition device produces high voltage required for igniting the discharge lamp and is conventionally arranged in a housing which is screened from electromagnetic radiation. In particular during its utilization for a discharge lamp as a light source of illuminating devices in motor vehicles, only a limited space is available so that the ignition device must be as compact as possible. Moreover, the ignition device must be arranged as close as possible to the discharge lamp, so that it is not necessary to provide long high voltage conductors.

SUMMARY OF THE INVENTION

Accordingly, it is an object of present invention to provide an ignition device for a discharge lamp, which is a further improvement of the known ignition devices.

In keeping with these objects and with others which will become apparent hereinafter, one feature of the present invention resides, briefly stated, in an ignition device for a discharge lamp having at least one inductive component and at least one capacitive component, wherein in accordance with the present invention at least a part of one component of the ignition device surrounds at least a part of the other component, and the components are arranged in a housing which is connectable with the discharge lamp.

When the ignition device is designed in accordance with the present invention, it has a compact construction obtained due to a mutually embracing arrangement of the components. Because of the compact construction of the ignition device with the housing which receives it, it can be connected with the discharge lamp so that no high voltage conductors are needed between the ignition device and the discharge lamp.

In accordance with a further advantageous feature of the present invention, the housing forms a base of the discharge lamp, with which its discharge container is connected. When the ignition device is directly integrated in the base of the discharge lamp, only a few additional components are needed.

In accordance with a further embodiment of the present invention, the housing is a plug part which is connectable with a base of the discharge lamp. With this feature a conventional discharge lamp is utilized, and from the plug part only low voltage conductors are extended for connection with a voltage source or a control device.

In accordance with another feature of the present invention, the coil winding or the secondary winding is arranged on a winding body, inside which at least a part of the capacitive component is located. In this construction the capacitive component is simply arranged inside the inductive component.

The winding body can be composed of an electrically insulating material and the capacitive component can be provided with at least two electrodes which are separated from one another by a material which is different from the material of the winding body and acts as dielectric. This construction has the advantage that the selection of the material for the dielectric and the winding body can be performed independently from one another with consideration of the required properties for each of them.

In accordance with still a further feature of the present invention, the winding body is formed of one piece with a bottom part of the base of the discharge lamp, with which its discharge container is connected. This allows a simple mounting of the base of the discharge lamp.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a discharge lamp with a base and an ignition device arranged in it in accordance with a first embodiment of the present invention;

FIG. 2 is a view showing the base of the discharge lamp with the ignition device in accordance with a second embodiment of the present invention;

FIG. 3 is a view showing the base of the discharge lamp with the ignition device in accordance with a third embodiment of the present invention;

DESCRIPTION OF PREFERRED EMBODIMENTS

Figure 4:
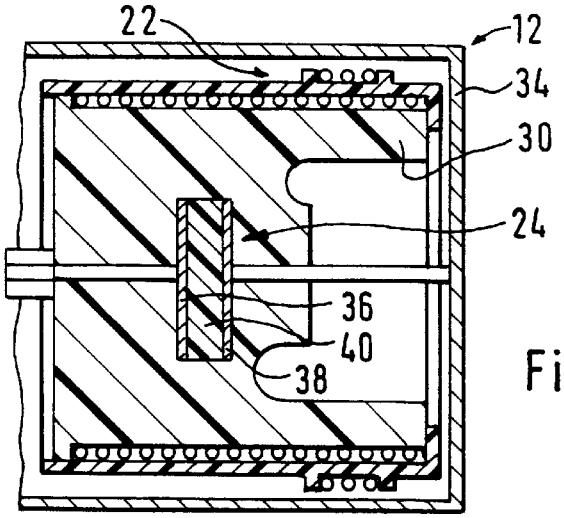
FIG. 4 is a view showing the base of the discharge lamp with the ignition device in accordance with a fourth embodiment of the present invention.

A discharge lamp shown in FIGS. 1–6 is utilized in particular for illumination devices of vehicles. It has a discharge container 10 connected with a base 12. A discharge container 10 is composed for example of glass, in particular quartz glass. At least two electrodes 14 and 15 are arranged in the discharge container 10 as well as a filler of mercury and in some cases metal halogenide and noble gas. During the operation of the discharge lamp, a light arc is formed between the electrodes 14 and 15. The discharge lamp can be inserted for example through a lamp carrier 16 into a reflector 18 of a vehicle headlight. For starting the operation the discharge lamp must be ignited, for which purpose a high voltage is required and produced by an ignition device.

FIG. 1 shows the discharge lamp with the ignition device in accordance with the first embodiment of the invention. The discharge container 10 is connected with a bottom part 20 of the base 12. The base has a definite supporting surface 21, through which the discharge lamp comes to abutment during insertion in the illumination device. The bottom part 20 can be composed for example of synthetic plastic material.

The ignition device has at least one inductive component 22 with at least one coil winding, and at least one capacitive component 24 which form an electrical resonant circuit. In the first embodiment shown in FIG. 1 the inductive component 22 has an air coil arrangement in form of a Tesla transformer having two air coil windings. A primary winding 26 has a relatively low number of windings and a secondary winding 28 has more winding than the primary winding. The primary winding 26 in the embodiments of FIGS. 1 and 6 can be arranged inside the secondary winding, or as shown in FIGS. 2 and 4 it can be arranged outside the secondary winding 28 so as to surround the latter.

The coil windings 26, 28 of the inductive component 22 are arranged at least approximately coaxially to the longitudinal axis 11 of the discharge container 10 and at the side of the bottom part 20 which faces away from the discharge container 10. The secondary winding 28 is arranged on a winding body 30 with a substantially cylindrical outer shape, while the primary winding 26 is arranged inside the base 12, for example on a supporting element abutting against the winding body 30 in the end region of the secondary winding 28 which faces away from the bottom part 20. Alternatively, the primary winding 26 can be arranged on the same winding body 30 as the secondary winding 28. The primary winding 26 is electrically connected with a supply conduit from a voltage source or a control device.

The end of the secondary winding 28 arranged near the bottom part 20 is electrically connected with the electrode 14 of the discharge container 10. A loose coupling is provided between the primary winding 26 and the secondary winding 28 as considered from the electrical circuit. The winding body 30 is hollow and connected with the bottom part 20. The capacitive component formed as a high voltage capacitor 24 is arranged inside the winding body 30. In a known manner, it can be formed as a plate capacitor as a cylindrical capacitor, or as a ball capacitor. The capacitor 24 can be arranged as a discrete component in the winding body 30. The capacitor 24 is surrounded by the coil winding, in particular the secondary winding 28 of the inductive component 22. The inductive component 22 is surrounded by a cup-shaped housing part 34 which is connected at its open end with the bottom part 20.

The housing part 34 is composed preferably of a material which screens electromagnetic radiation, for example metal, such as aluminum. The bottom part 20 and the housing part 34 together form the base 12 of the discharge lamp and enclose a chamber in which the components 22, 24 of the ignition device are located. An electrode of the capacitor 24 is also connected with the electrode 14. The other electrode 15 of the discharge container 10 and the other electrode of the capacitor 24 are electrically connected with the housing part 34. The housing part 34 forms a screening which screens the electromagnetic radiation produced by the components 22, 24 of the ignition device.

The space between the inductive component 22 and the housing part 34 is preferably filled with electrically insulating material, for example synthetic plastic material, preferably by casting. The housing part 34 can be alternatively composed of synthetic plastic material, and then no electromagnetic screening is performed by it. In this case, the space between the inductive component 24 and the housing part 34 must not be filled with the electrically insulating material. The bottom part 20 and the housing part 34 together form a housing in which the components 22, 24 of the ignition device are arranged and which form the base 12 of the discharge lamp. A compact construction of the base 12 of the discharge lamp is made possible by the arrangement of the inductive component 22 surrounding the capacitor 24.

A supply conductor of a low voltage source or a control device is releasably or non-releasably connected to the base 12. The control device is used to provide a stable operation of the discharge lamp after its ignition. In some cases it can contain further components which belong to the ignition device. The housing part 34 can be composed of another material for example synthetic plastic material. Then the other electrode of the capacitor 24 is electrically connected with the electrode 15 of the discharge container 10, but no electrical connection is provided between the housing part 34, the electrode 15 of the discharge container 10, and the electrode of the capacitor 24. A space for an electrical connection of the gas discharge lamp can be formed inside the hollow winding body 30 to the bottom of the housing part 34, for example for a plug connector. In this case the bottom of the housing part 34 is provided with an opening.

FIG. 2 shows the base 12 of the discharge lamp with the ignition device in accordance with a second embodiment. The basic construction of this embodiment is similar to the first embodiment. However, the construction of the capacitor 24 is modified. The capacitor 24 has two electrodes 36, 38 of electrically conductive material. They are plate-shaped and arranged at a distance from one another in the winding body 30. The electrodes 36, 38 are imbedded in the material of the winding body 30 and injection molded by it. The material of the winding body 30 at least in the region between the electrodes 36, 38 operates as dielectric. The electrode 36 of the capacitor 24 extending to the bottom part 20 of the base 12 is electrically connected with the electrode 14 of the discharge container 10. The other electrode 38 of the capacitor 24 arranged toward the bottom of the housing part 32 is electrically connected with the electrode 15 of the discharge container 10. The electrical connection of the electrode 15 with the electrode 38 of the capacitor 24 can be formed for example through the housing part 34, when it is composed of electrically conductive material for electromagnetic screening. The capacitor 24 is formed in a simple manner by the electrodes 36, 38 and the winding body 30. By suitable selection of the size of the electrodes 36, 38, of their distance from one another, as well as of the material operating as dielectric, the capacity of the capacitor 24 which is needed for the operation of the ignition device can be provided.

FIG. 3 shows the base 12 of the discharge lamp with the ignition device in accordance with a third embodiment of the invention. Here also the basic construction of the device corresponds to that of the first embodiment. However, the bottom part 20 of the base 12 is formed of one-piece with then winding body 30. The bottom part 20 and the winding body 30 can be formed of one-piece with one another for example by injection molding from synthetic plastic material. The design of the capacitor 24 can be as in the first embodiment, or the capacitor 24 as in the second embodiment can be integrated in the winding body 30. The inductive component 22 is formed as a Tesla transformer. Its primary winding 26 and its secondary winding 24 are arranged approximately coaxially with one another on the same winding body 30. However, they are offset in direction of the longitudinal axis 27 of the coil windings 26, 28 relative to one another and arranged separately from one another. The arrangement of the coil windings 26, 28 can be utilized in the both preceding embodiments instead of the arrangements described there.

FIG. 4 shows the base 12 of the discharge lamp with the ignition device in accordance with a fourth embodiment. The basic construction here is not changed from the second embodiment, however, the construction of the capacitor 24 is modified. The capacitor 24 has a plate 40 composed of material acting as dielectric. At its both sides facing away from one another, electrodes 36, 38 of electrically conductive material are provided. The electrodes 36, 38 can be for example glued or soldered on the plate 40, or can be applied in form of a coating on the plate 40. The capacitor 24 is arranged in the winding body 30 and can be injection molded with the material of the winding body 30. Connections for the electrodes 36, 38 of the capacitor 24 extend through the winding body 30 for connecting with an electrode of the discharge container or the housing part 34. This embodiment of the capacitor 24 provides the advantage that for the plate 40 a material can be used which has the required dielectric properties, while for the winding body 30 a material can be used which has the required mechanical properties, for example a good thermal strength. Also, a weight reduction of the winding body 30 with the capacitor 24 arranged in it can be provided, since the winding body 30 can be composed of a lighter material than the plate 40 acting as dielectric. A commercial standardized discreet component can be used as the capacitor 24.

Figure 5:
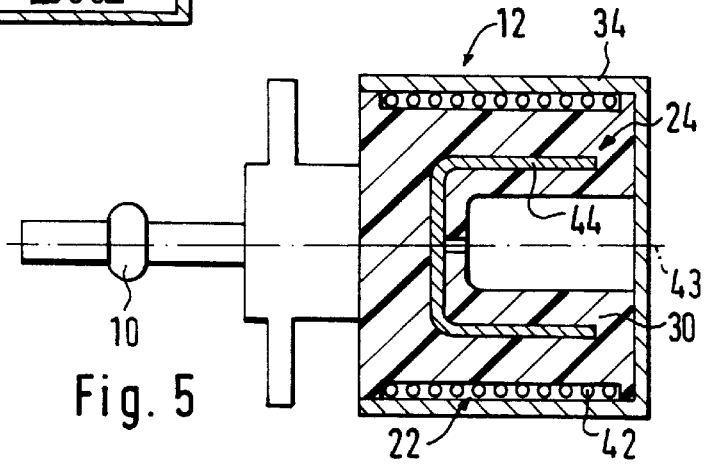
FIG. 5 is a view showing a section of the base of the discharge lamp with the ignition device in accordance with the first embodiment of the present invention.

FIG. 5 shows the base 12 of the discharge lamp with the ignition device in accordance with a fifth embodiment. The basic construction is not changed from the first embodiment, but the constructions of the inductive component 22 and the capacitor 24 are modified. The inductive component 22 is formed as an air coil which has only a single coil winding 42 arranged on the winding body 30. One end of the coil winding 42 is electrically connected with a supply conductor for low voltage, while the other high-voltage-side end of the coil winding 42 is electrically connected with the electrode 14 of the discharge container 10. An electrode 44 of the capacitor 24 is arranged in the winding body 30 and formed as a hollow cylinder. Its longitudinal axis extends at least approximately coaxially to the longitudinal axis 43 of the coil winding 42. The width of the electrode 44 in direction of the longitudinal axis 43 is substantially equal to or somewhat smaller than the width of the coil winding 42. The electrode 44 is enclosed by the material of the winding body 30, for example injection molded with it, and operates as dielectric. The second electrode of the capacitor 24 is formed by the coil winding 42 which is separated from the electrode 44 by the material of the winding body 30 acting as dielectric. The electrode 44 of the capacitor 24 is electrically connected with the electrode 15 of the discharge container 10. The housing part 34 is electrically not conductive and operates only for a mechanical protection. When the housing part 34 is electrically conductive for electromagnetic screening, than the distance between the housing part 34 and the coil winding 42 must be greater than the distance between the coil winding 42 and the electrode 44 of the capacitor 24. The space between the coil winding 42 and the housing part 34 is preferably filled with electrically insulating material. The width of the electrode 44 as well as the distance between the electrode 44 and the coil winding 42 and the material acting as the dielectric are selected so that the capacitor 24 has the capacity needed for operation of the ignition device. This embodiment of the condensator 24 can be used when the inductive component 22, as in the first four embodiments, is formed as a Tesla transformer. In this case the secondary winding of the Tesla transformer is utilized as the second electrode of the capacitor 24.

Figure 6:
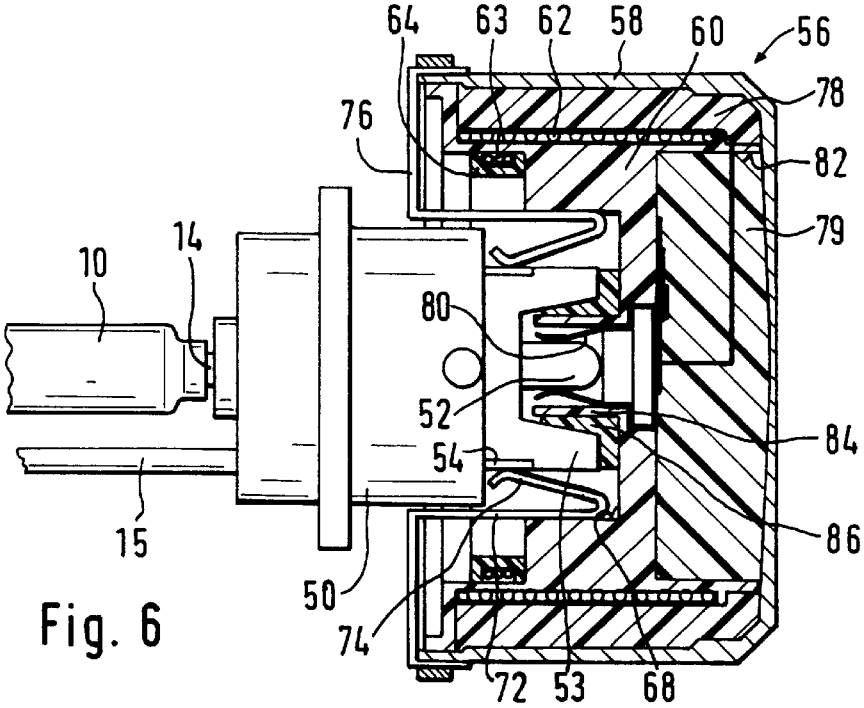
FIG. 6 is a view showing a section of the discharge lamp with a base part with the ignition device connected to it in accordance with a sixth embodiment.

FIG. 6 shows the discharge lamp with the ignition device in accordance with a sixth embodiment. Here a conventional discharge lamp is utilized, whose discharge container 10 is connected with a base 50. A plug connection for the electrodes of the discharge container 10 is arranged on the base 40. The plug connection has a plug pin 52 electrically connected with the electrode 14. It is surrounded by a projection 53 of the base 50. The plug connection also has a conductor ring 54 arranged on the outer periphery of the projection 53 and electrically connected with the electrode 15.

The ignition device has substantially the same components as in the preceding embodiments. However, it is arranged in a plug part 56 which is connectable with the base 50 of the discharge lamp. The plug part 56 has a cup-shaped housing part 58 of electrically conductive material, for example metal. A winding body 60 of electrically insulating material is arranged in the housing part 58, and a coil winding of the inductive component is arranged on it. The inductive component in the shown embodiment is formed as a Tesla-transformer, and its secondary winding 62 is arranged on the winding body 60. The primary winding 63 of the Tesla-transformer is arranged on a support element 64 at least approximately coaxially inside the secondary winding 62 in the end region of the secondary winding 62 which faces the open end of the housing part 58. The primary winding 63 can be alternatively at least approximately coaxially surround the secondary winding 62 as in FIGS. 2 and 4. In accordance with a further alternative, the primary winding 63 as in the embodiment of FIG. 3 can be arranged on the same winding body 60 as the secondary winding 62, however offset in direction of the longitudinal axis of the coil windings 62, 63 and separate from it. The inductive component can be alternatively formed as an air coil, and then only one coil winding arranged on the winding body 60 is available. The winding body 60 as shown in FIG. 6 can extend to the bottom of the cup-shaped housing part 58 or and before it.

The winding body 60 has a recess 68 which is at least approximately coaxial to the coil winding 62, 63. A ring-shaped electrical contact element 72 is inserted in the recess 68 and has several inwardly extending springy contact arms 74. The contact element 72 has an outwardly projecting flange 76 which extends to the upper end of the housing part 58 and is electrically connected with the housing part 58.

The intermediate space between the outer periphery of the winding body 60 and the housing part 58 is filled with material 78 acting as dielectric, in particular by casting. A hollow space provided between the bottom of the housing part 34 and the recess 82 of the winding body 60 which faces the same can be filled for example with electrically insulating material 79, in particular by casting. The material 79 can be the same as the material 78 or a different material. The winding body 60 has an opening which is at least approximately coaxial to the recess 68. An electrical contact element 18 form of at least one springy contact arm or a plug sleeve extends through the opening. It is electrically connected with the end of the secondary winding 62 arranged near the bottom of the housing part 58, or with the single coil winding. The plug sleeve 80 is surrounded by a collar 84 extending in the recess 68 at least approximately coaxially. The collar 84 extends from the winding body 60. An elastically compressable sleeve 86 is arranged on the collar 84. The capacitor of the ignition device has two electrodes. One electrode is formed by the secondary winding 62 or the single coil winding, while the other electrode is formed by the housing part 58. Both electrodes are separated by the material 78 which acts as dielectric. By a suitable selection of the distance between the secondary winding 62 or the single coil winding and the housing part 58 which surrounds it, as well as by suitable selection of the material 78, they capacitive of the capacitor can be brought to the value required for the operation of the ignition device.

The plug part 56 has at least one connecting conduit for a low voltage for connection to a voltage source, in some cases through a control device which guarantees a stable operation of the discharge lamp after each ignition. A screened housing is formed by the housing part 58 and a flange 76 of the contact element 72. The components of the ignition device are arranged in the screened housing, and it is connected with the base 50 of the discharge lamp by fitting on it. The projection 53 of the base 50 is inserted in the recess 68 of the winding body 60 of the plug part 56. The contact arms 74 of the contact element 72 abut with pretensioning against the conductor ring 54 and the plug pin 52 is inserted in the plug sleeve 80. The collar 54 and the sleeve 86 which surrounds the collar are inserted in the projection 53 of the base 50 and form a seal for high voltage insulation between the plug sleeve 80 and the contact elements 72, 74.

In the ignition device in accordance with the sixth embodiment, the housing part 58 which forms the electrode of the capacitor surrounds the secondary winding 62 or the single coil winding of the inductive component. Thereby a compact construction of the plug part 56 connected with the discharge lamp is possible. The arrangement of the components of the ignition device in accordance with the seventh embodiment can also be used when the ignition device, as in the first-sixth embodiments, is arranged in the base 12 of the discharge lamp.

It will be understood that each of the elements described above, or two or more together, may also find a useful application in other types of constructions differing from the types described above.

While the invention has been illustrated and described as embodied in ignition device for discharge lamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A discharge lamp assembly, comprising a discharge lamp; and an ignition device for said discharge lamp, said ignition device including at least one inductive component and at least one capacitive component, at least a part of one of said components being surrounded by at least a part of the other of said components, said ignition device further having a housing in which said components are arranged and which is connectable with said discharge lamp.

2. A discharge lamp assembly as defined in claim 1, wherein said discharge lamp has a base and a discharge container, said housing forming said base of said discharge lamp and is connected with said discharge container.

3. A discharge lamp assembly as defined in claim 1, wherein said housing is formed as a plug part, said discharge lamp having a base which is connectable with said plug part.

4. A discharge lamp assembly as defined in claim 1, wherein said housing is formed so as to screen electromagnetic radiation.

5. A discharge lamp assembly as defined in claim 1, wherein said at least one inductive component has at least one coil winding, at least a part of said coil winding surrounding at least a part of said capacitive component.

6. A discharge lamp assembly as defined in claim 1, wherein said at least one inductive component has at least one coil winding, said capacitive component having at least one electrode which surrounds said at least one coil winding.

7. A discharge lamp assembly as defined in claim 1, wherein said inductive component is formed as an air coil structure.

8. A discharge lamp assembly as defined in claim 7, wherein said inductive component is formed as an air coil having a single coil winding.

9. A discharge lamp assembly as defined in claim 7, wherein said inductive component is formed as a Tesla-transformer which has a primary winding and a secondary winding which is arranged at least approximately coaxially to said primary winding.

10. A discharge lamp assembly as defined in claim 1 wherein at least one of said components has a winding selected from the group consisting of a coil winding and a secondary winding and further comprising a winding body, at least one of said coil winding and said secondary winding being arranged on said winding body, at least a part of said capacitive component being arranged inside said winding body.

11. A discharge lamp assembly as defined in claim 10, wherein said winding body at least partially is composed of material acting as dielectric, at least one electrode is arranged in said winding body for forming said capacitive component and at least a second electrode is arranged separately from said first electrode by the material acting as the dielectric.

12. A discharge lamp assembly as defined in claim 11, wherein at least two said electrodes of said capacitive component are arranged in said winding body.

13. A discharge lamp assembly as defined in claim 11, wherein at least one second electrode of said capacitive component is formed by at least one of said coil winding and said secondary winding.

14. A discharge lamp assembly as defined in claim 13, wherein said electrode of said capacitive component which is arranged in said winding body is formed as a hollow cylinder and located at least approximately coaxially to a longitudinal axis of at least one of said coil winding and said secondary winding.

15. A discharge lamp assembly as defined in claim 10, wherein said winding body is composed of an electrically insulating material, said capacitive component having two electrodes which are separated from one another by material which is different from a material of the winding body and acts as dielectric.

16. A discharge lamp assembly as defined in claim 15, wherein said electrodes are formed as electrically conductive coatings provided on opposite sides of the material acting as dielectric.

17. A discharge lamp assembly as defined in claim 10, wherein said winding body is formed of one-piece with a bottom part of a base of said discharge lamp, with which said discharge container is connected.

18. A discharge lamp assembly as defined in claim 1, wherein at least one of said components has a winding selected from the group consisting of a coil winding and a secondary winding, at least one of said coil winding and said secondary winding being surrounded by a part of said housing of electrically conductive material, a material acting as dielectric being arranged between at least one of said coil winding and said secondary winding and said part of said housing, and at least one of said coil winding and said secondary winding and said part of said housing, and at least one of said coil winding and said secondary winding forming a first electrode while said part of said housing forming a second electrode of said capacitive component.

19. A discharge lamp assembly as defined in claim 18, wherein said part of said housing at least approximately coaxially surrounds at least one of said coil winding and said secondary winding.

* * * * *